United States Patent [19]

Criscione

[11] 4,406,207

[45] Sep. 27, 1983

[54] PERCUSSION PRACTICE PAD

[76] Inventor: John J. Criscione, 1377 W. 6th St., Brooklyn, N.Y. 11204

[21] Appl. No.: 327,404

[22] Filed: Dec. 4, 1981

[51] Int. Cl.[3] ..... G10D 13/02

[52] U.S. Cl. ..... 84/411 P; 84/421

[58] Field of Search ..... 84/411 P, 327, 421

[56] References Cited

U.S. PATENT DOCUMENTS

| | | | |
|---|---|---|---|
| 1,285,802 | 11/1918 | Russell | 84/327 |
| 2,338,816 | 1/1944 | Lockhart | 84/411 P |
| 2,475,873 | 7/1949 | Banta | 84/411 P |
| 3,166,970 | 1/1965 | Ellman | 84/411 P |
| 3,955,461 | 5/1976 | Ivie | 84/327 |
| 3,979,993 | 9/1976 | Proctor | 84/327 |

FOREIGN PATENT DOCUMENTS

| | | | |
|---|---|---|---|
| 2135 of 1862 | | United Kingdom | 84/411 P |
| 1493136 | 11/1977 | United Kingdom | 84/411 P |

*Primary Examiner*—Lawrence R. Franklin

*Attorney, Agent, or Firm*—Lackenbach, Siegel, Marzullo, Presta & Aronson

[57] ABSTRACT

A percussion practice pad is formed of a panel supporting a layer of material for intercepting blows of drum sticks and for muting sounds produced by the striking of the drum sticks. The panel which serves as a base for resisting forces of the drum sticks is made of wood or plastic and is spaced apart by normally disposed wall members from a cushioned contact surface. The contact surface may be formed directly within an edge of a wall member, or within a plate attached thereto, and is curved so as to mate comfortably with the leg of a percussionist during use. The pad is adapted by means of an adjustable strap to be comfortable and stably secured about the thigh of the user.

11 Claims, 14 Drawing Figures

FIG. 6
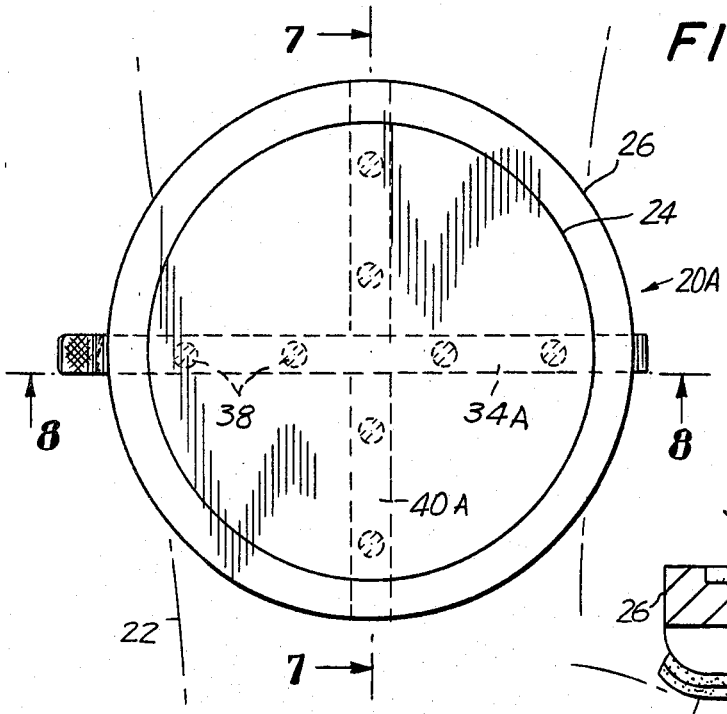
FIG. 14
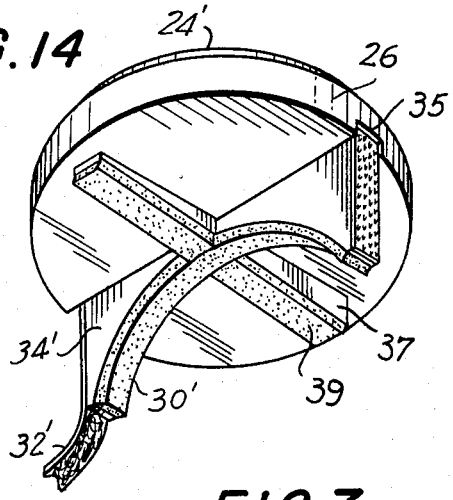
FIG. 7
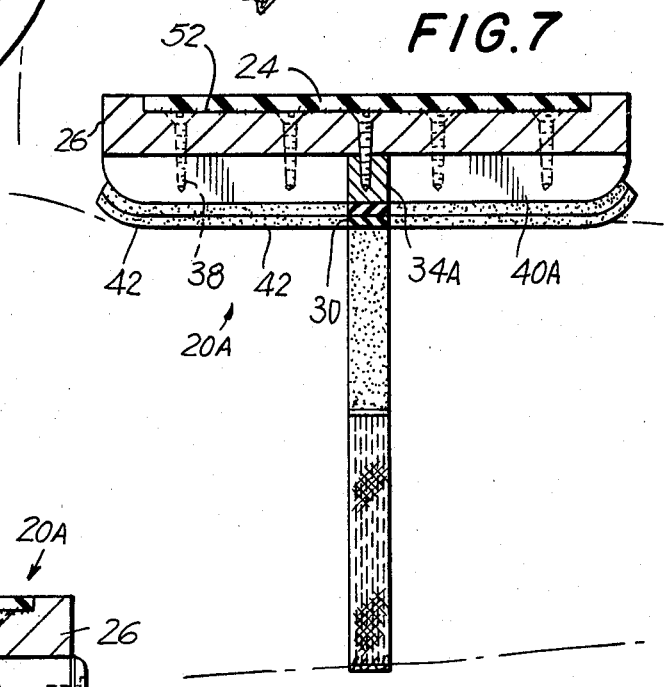
FIG. 8
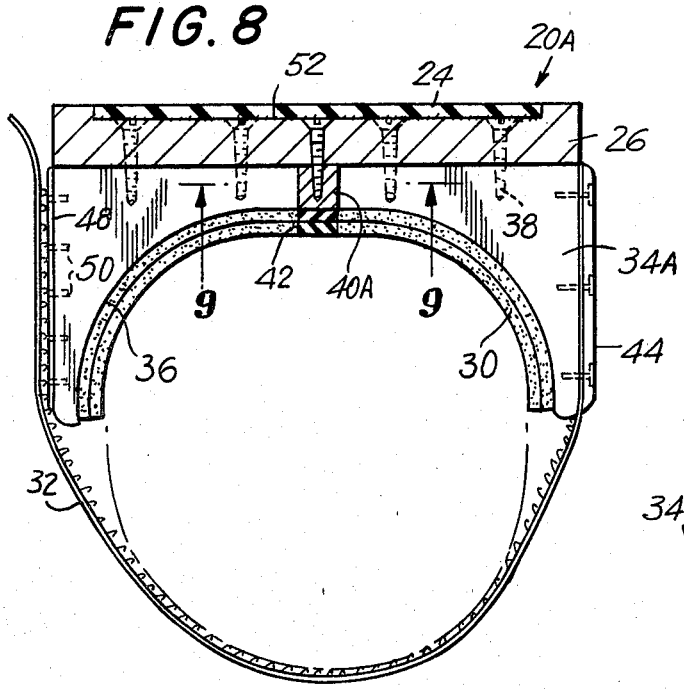
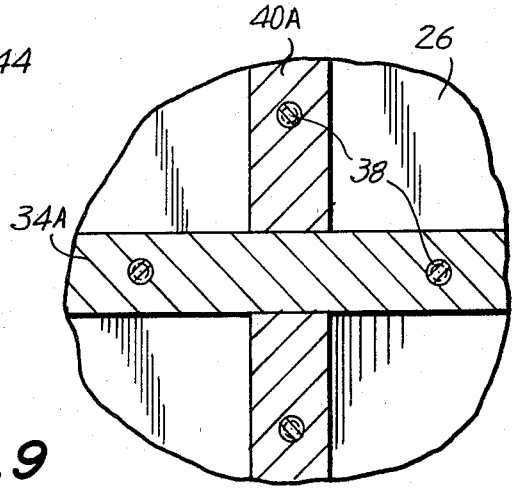
FIG. 9

PERCUSSION PRACTICE PAD

BACKGROUND OF THE INVENTION

This invention relates to a percussion instruments and, more particularly, to a portable practice pad.

Percussionists need the opportunity to practice their instruments in preparation for concerts and other musical events. Often, such opportunity presents itself while enroute to the concert, or at a site wherein it would be inconvenient to set up a set of drums.

Thus, a problem exists in that a percussionist, particularly a drummer, may wish to practice his drum in a situation in which no noise is permitted, and in which there is no room or time to set up the drums. One solution that has been proposed is the use of a practice pad which is worn on the leg or the drummer, one such pad being disclosed in the U.S. Pat. No. 2,338,816 of Lockhart, and other such pads being disclosed in the British Pat. Nos. 2135 of Azemar and 1,493,136 of McDermott. However, the foregoing pads have not been as comfortable and stable as would be desired.

SUMMARY OF THE INVENTION

The foregoing problem is overcome and other advantages are provided by the practice pads constructed in accordance with the invention for providing improved comfort to the wearer and increased stability while being worn on the leg of a drummer or percussionist. The pad comprises a rigid base, typically of wood or plastic, supporting a layer of soft rubber, suitably secured, such as by adhesives to the base for receiving and muting the blows of the drum sticks.

In accordance with a feature of the invention, the base is disposed upon a support which is adapted to elevate the base above the thigh or knee of the wearer by a predetermined amount, the lower edge of the base being cushioned and extending in an arcuate surface for mating with the thigh of the wearer. The length of the surface is commensurate with the width of the base so as to provide increased stability in accordance with the size of the pad. The height of the support provides the desired elevation of the base above the thigh of the wearer.

In an alternative miniaturized form or modification of the pad, the base is significantly narrower than the width of the thigh, the support is modified to include a lower plate connected by legs to the base, the width of the plate being so narrow or small and because of the resiliency of the cushioning thereon, accommodating for the arcuate surface of the thigh is of minor concern. The pad is secured to the thigh by a strap which may be buckled or, preferably, is formed of a texturized gripping fabric, known as a Velcro fabric, for rapid and accurate securing of the pad.

BRIEF DESCRIPTION OF THE DRAWINGS

The foregoing features and other advantages of the invention are explained in the following description taken in connection with the accompanying drawings wherein:

FIG. 6 is a plan view of an alternative embodiment of the practice pad of the invention;

FIG. 7 is a cross-sectional view of the pad, generally taken along the line 7—7 in FIG. 6;

FIG. 8 is a cross-sectional view of the pad, generally taken along the line 8—8 in FIG. 6;

FIG. 9 is a fragmentary view looking up at the support along the line 9—9 in FIG. 8;

FIG. 14 is a modification of the embodiment of FIG. 1 showing an inclination of a stabilizing strut for supporting the practice pad on an inclined leg of a drummer.

DESCRIPTION OF THE PREFERRED EMBODIMENTS

Figure 1:
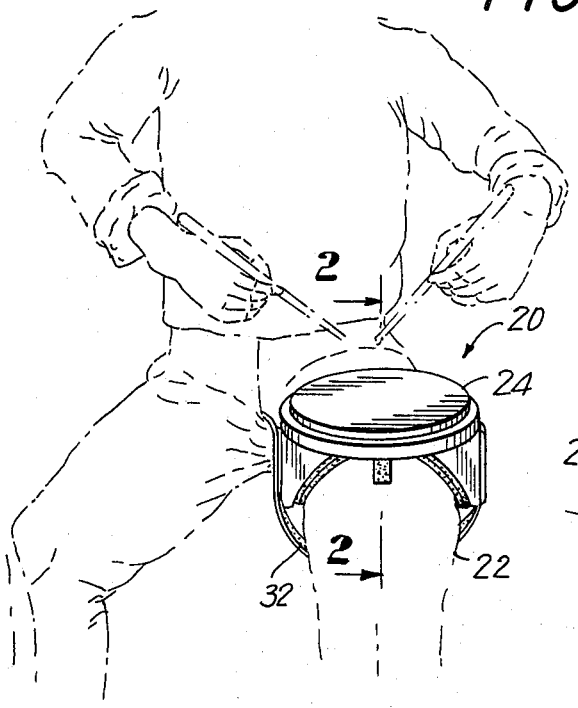
FIG. 1 shows a perspective view of a drummer practice pad constructed in accordance with the invention, the Figure further showing a stylized view of a drummer in phantom to demonstrate the deployment of the pad upon the thigh at the knee.
Figure 2:
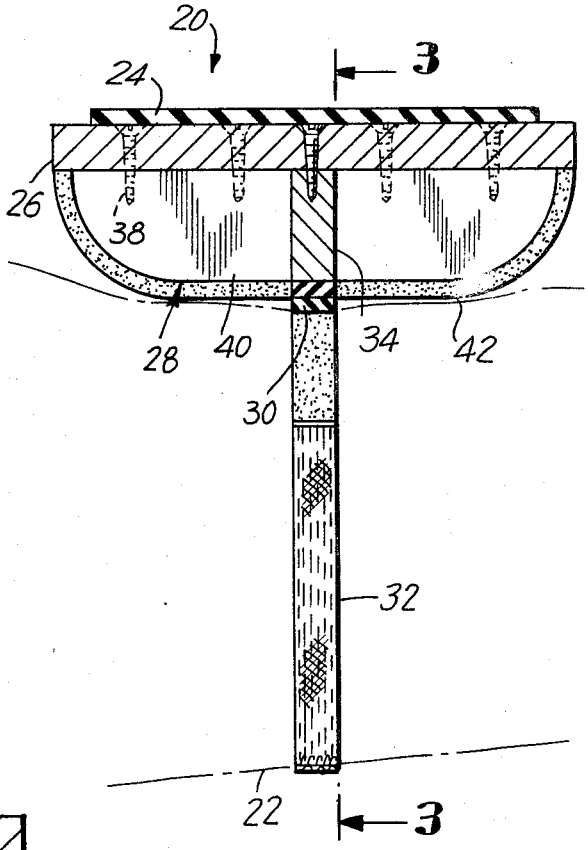
FIG. 2 is a sectional view of the pad, generally taken along the line 2—2 in FIG. 1.
Figure 3:
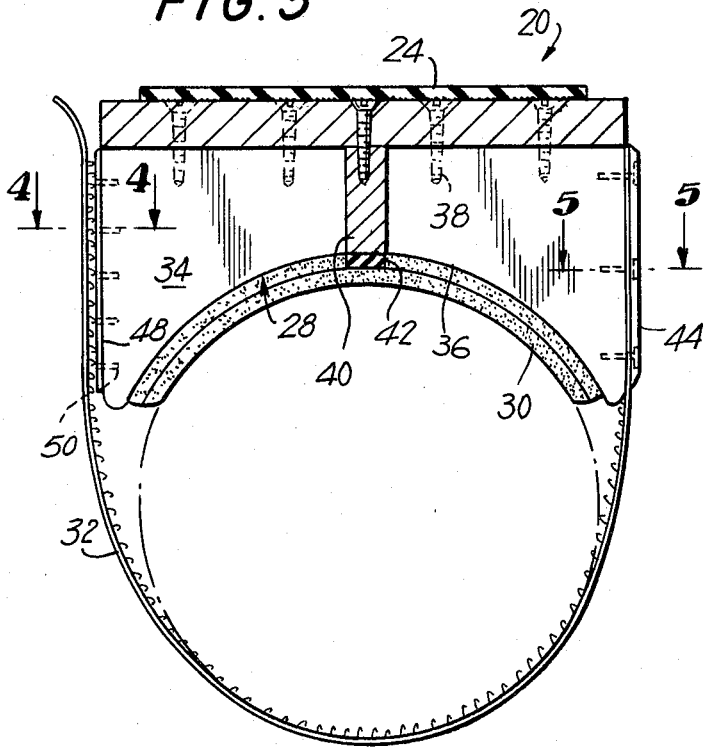
FIG. 3 is a sectional view, generally taken along the line 3—3 in FIG. 2.
Figure 4:
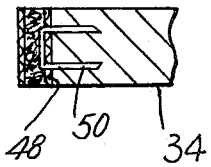
FIG. 4 is a fragmentary, cross-sectional view, taken along the line 4—4 in FIG. 3, showing the securing of a Velcro strap to a support member of the pad.
Figure 5:
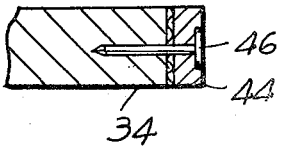
FIG. 5 is a fragmentary, cross-sectional view, taken along the line 5—5 in FIG. 3, showing the securing of the opposite end of the strap to the support member.

Referring now to FIGS. 1-5, a drummer's percussionist's practice pad 20 is shown set upon the thigh near the knee of a drummer 22. The pad 20 comprises a layer 24 of shock absorbing material, preferably adhesively secured to a base 26 which is carried by a support 28. The bottom surface of the support 28 is cushioned by a cushion 30 for resting upon the thigh 21 of the drummer 22. Strap 32 is attached to the support 28 so as to be readily around the thigh 21 of the drummer 22 to secure the pad 20 to the thigh 21.

In accordance with the invention, the support 28 comprises a transverse wall 34 having an elongated arcuate surface 36 which generally follows the contour of the drummer's thigh, the cushion 30 being secured, preferably by adhesives to the wall 34 at the surface 36. The strap 32 is advantageously formed of a flexible material having interlocking elements, such as hook and eye elements, as for example, a Velcro fabric, for convenience in securing and adjustment of the strap 32. (Velcro is a trademark of the Velcro Corporation of America of New York, N.Y.).

The wall 34 is conveniently secured to the base 26 by fasteners, such as screws 38 which, in the manufacturing process, are conveniently installed through the base 26 prior to the securing of the layer 24. The height of the wall 34 is preset to a predetermined amount in accordance with the desired amount of elevation of the base 26 above the drummer's thigh 21. The wall 34 is suitably buttressed and strengthened by stabilizing struts 40 mounted perpendicularly thereto and secured in a like manner to the base 26 by fasteners, such as screws 38. The struts 40 are also suitably cushioned with a resilient material, such as cushions 42 adhesively secured to the lower surfaces thereof. One end (fixed one) of the strap 32 is suitably secured by an adhesive, or, alternatively, by a plate 44 and nails 46 at one end of the wall 34, while the second end of the strap 32 is free to be engaged with a strip 48 of gripping or interlocking material, such as the noted foregoing Velcro fabric, the strip 48 being suitably secured to the opposite end of the wall 34 as by an adhesive or, alternatively, by staples 50. Alternatively, the fixed end of the strap 32 may also, if desired, by suitably connected to one end of the wall 34 by adhesives, or fasteners without the use of a plate 44.

The base 26, the wall 34 and the struts 40 may be conveniently fabricated of a rigid material having pleasant sound properties, preferably any wood, for example, birch. Alternatively, metal, rubber rigid foam or a plastic material, such as a polyvinyl-chloride (PVC) plastic may be utilized. The sound-muting and drum stick rebounding properties of the layer 24 are attained by fabricating the layer 24 of a natural or synthetic rubber. The cushions 30 and 42 are preferably fabricated of a soft resilient material having good shock absorbing properties, such as foamed plastic materials, for example, polyurethene. If plastic is utilized in the practice pad construction, then it becomes possible to integrally mold the base, wall and the strut as a unitary structure. Thus, a lightweight, durable, small and compact practice pad which preferably would weigh-in at about one pound or so may be suitably made from the above-referred materials. Also, the pad of the invention overcomes the well known "creeping" problem associated with the prior art devices as they tend to slide away from a percussionist during use, particularly continuous heavy use.

Referring now to FIGS. 6–9, there is shown an embodiment of a pad 20A of the invention which differs from that disclosed in FIGS. 1–5 by a reduction in the heights of the wall and the struts, the wall 34A and the struts 40A of the pad 20A being lower than the wall 34 and the struts 40 to reduce the elevation of the base 26 above the thigh 21 of the drummer 22. The base of the pad of FIGS. 6–9 has also been modified to provide a base 26A having a recess 52 for receiving the layer 24, the layer 24 thereby being recessed to provide a substantially flush face to the pad 20A.

Also, as a further feature in the embodiment of FIGS. 6–9, the arcuate path of the wall 34A is longer and steeper (rather than shallow) and extends further for contacting more of the drummer's thigh. Thus, it is seen that the aspect ratio of the wall 34A, providing a greater ratio of length to height, introduces greater stability to maintaining the orientation of the pad 20A upon the drummer's thigh.

Figure 10:
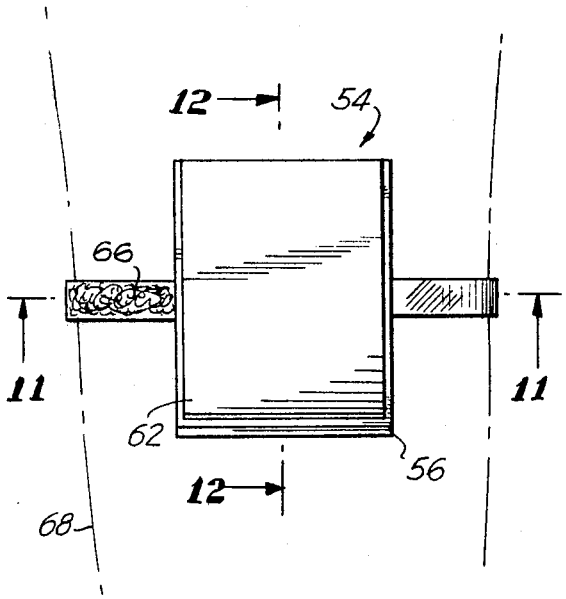
FIG. 10 is a plan view of a modification or miniaturized embodiment of the practice pad of the invention.
Figure 11:
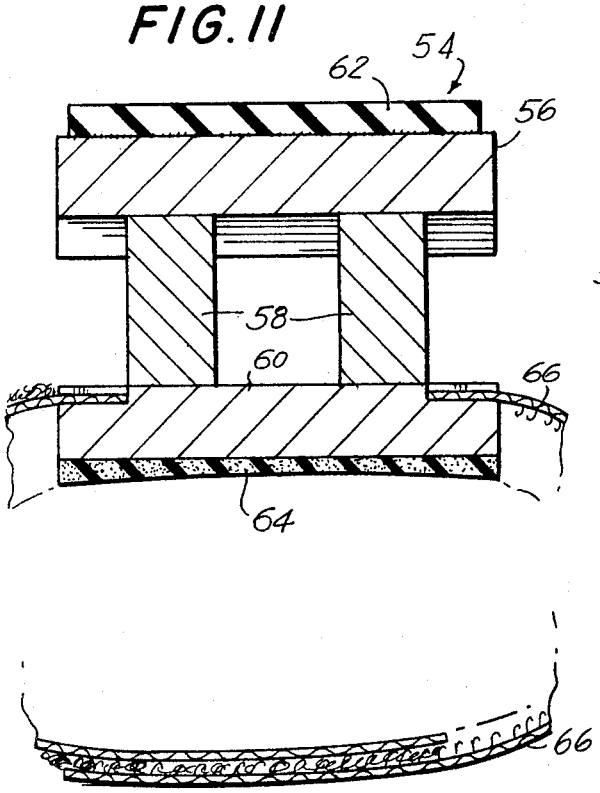
FIG. 11 is a cross-sectional view of the pad, generally taken along the line 11—11 in FIG. 10.
Figure 12:
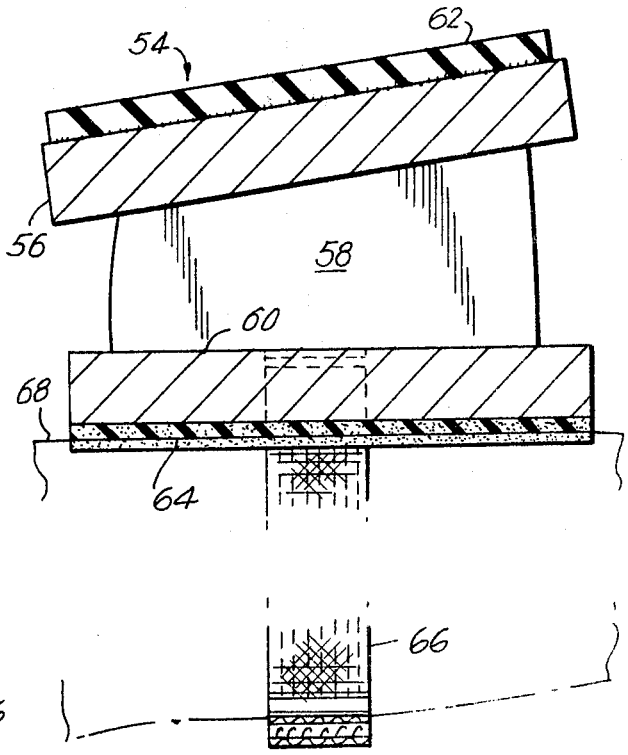
FIG. 12 is a cross-sectional view of the pad, generally taken along the line 12—12 in FIG. 10.

Referring now to FIGS. 10–12, there is presented a miniaturized practice pad 54 comprising a base 56 supported by legs 58 upon a plate 60. A layer 62 of rebounding and sound-muting material, such as for example, gum rubber is adhesively secured upon the top of the base 56 for receiving the blows of the drum sticks. A cushion 64 of sponge rubber or a foamed plastic material is adhesively secured to the bottom of the plate 60 to provide for a comfortable resting of the pad 54 upon the thigh 21 of the drummer 22. A strap 66, similar to the strap 32, described above, is suitably attached as, for example, by adhesives, or staples (not shown), to the upper surface of the plate 60.

In the use of the pad 54, the width of the plate 60 is significantly less than that of the drummer's thigh as is shown in FIG. 10 by a thigh 68 drawn in phantom. Thus, the resiliency of the cushion 64 provides to a certain extent a mating surface for mating with the thigh 68. The height of the legs 58 is set to a predetermined amount as is required to provide the desired elevation to the base 56 of the practice pad 54 above the thigh 68.

Figure 13:
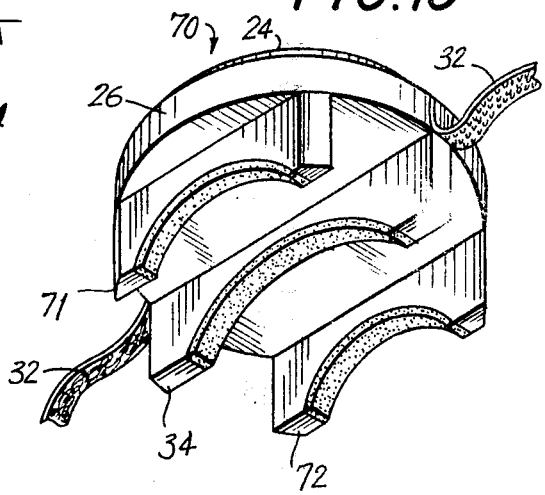
FIG. 13 is a further modification of the practice pad of the invention, showing an alternative form of support beneath the base.

With reference to FIG. 13, a further modification of the practice pad is presented. As shown therein, the pad 70 differs from the pad 20 of FIG. 1 by the provision of two additional walls 71–72 alongside the previously described wall 34. Other details in the use and construction of the pad 70 follow that previously presented for the pads 20 and 20A. The pad 70 provides further stability in two orthogonal directions, transversely and longitudinally, along the drummer's thigh. In contrast, the pad 20 permits a slight adjustment in position in the longitudinal direction by a slight tilting so as to accommodate the drummer's preferred position.

Referring now to FIG. 14, there is presented an alternative embodiment of the practice pad of FIG. 1. The pad of FIG. 14 comprises a layer 24' of rebounding and shock-muting material, preferably adhesively secured to a base 26. The base 26 is carried by a supporting structure comprising a wall 34' which is buttressed and strengthened by a stabilizing strut 37. The wall 34' has an arcuate edge covered by a cushion 30', while the strut 37 has an inclined edge covered by a cushion 39. Both the cushions 30' and 39 are secured to their respective edges by conventional and well known means, such as adhesives. The wall 34' sets within a channel 35 in the bottom surface of the base 26 which channel orients and positions the wall 34' relative to the base 26. A strap 32' is attached to the ends of the wall 34' for securing the pad to the thigh of a drummer. The attachment of the wall 34' to the base 26, and the attachment of the strap 32' to the wall 34' may follow that disclosed with reference to the embodiment of FIG. 1, but preferably they are secured by adhesives.

A further novel feature of the invention is found in the inclined edge of the strut 37. Since the strut 37 rests against the drummer's leg, as is the case with the strut 40 of FIGS. 1–3, the inclination of the edge and the cushion 39 thereon accommodates for an inclination of the drummer's thigh, as occurs when the drummer places his foot on a stool, so as to level the surface of the practice pad. The direction of the strut 37 is reversed by rotating the pad so as to compensate for an upward or downward inclination in the drummer's thigh, which primarily depends upon the height of the drummer's seat. But nevertheless this embodiment lends itself to leveling of the practice pad generally to a "sticking" relationship desired by the percussionist or to the plane of the floor so as to facilitate setting up a more comfortable and natural set-up position for the percussionist.

It is to be understood that the above-mentioned embodiments of the invention are illustrative only and that modifications thereof may occur to those skilled in the art. Accordingly, this invention is not to be regarded as limited to the embodiments disclosed herein, but is to be limited only as defined by the appended claims.

What is claimed is:

1. A percussion practice device comprising:

a base having at least one dimension wider than the width of the thigh of the intended user;

a layer of sound-muting material having rebounding properties carried by the top of said base;

supporting means fixed to the bottom of said base for spacing said base apart from said user by a predetermined spacing, said supporting means comprising a first wall member disposed normally to said base and adapted to extend transverse of said thigh, the bottom edge of said first wall member having an arcuate surface conforming to the curvature of said thigh, the ends of said arcuate surface adapted to extend down the sides of said thigh, said supporting means further comprising at least one additional wall member disposed normally to said base and having a bottom edge shaped to conform to the portion of said thigh which it is adapted to contact; and strap means coupled to the vertical edges of said first wall member for securing said device to the thigh of said user, said strap means including means for varying the degree of tightness in securing said device to said user.

2. A device according to claim 1 further comprising cushion means disposed along said bottom edge of each of said wall members.

3. A device according to claim 1 or 2 wherein said additional wall member comprises a strut disposed perpendicular to said first wall member.

4. A device according to claim 3, wherein said bottom edge of said strut is disposed at an angle with respect to said base, so as to facilitate leveling of said practice pad when worn by the user.

5. A device according to claim 3, wherein said bottom edge of said strut is parallel to said base.

6. A device according to claim 1 or 2 wherein said additional wall member comprises a strut disposed parallel to said first wall member, the bottom edge of said strut having a thigh conforming arcuate surface.

7. A device according to claim 6 wherein a second strut is disposed parallel to said first wall member, the bottom edge of said second strut having a thigh conforming arcuate surface.

8. A device according to claim 7, wherein said base, supporting means and said struts are all formed of a close grained wooded material, selected from the group consisting of birch, maple, ash and other like characteristics.

9. A device according to claim 1 or 2 wherein said strap means includes a Velcro fastening device.

10. A device according to claim 1 or 2 wherein said sound-muting material is disposed in a recess in said top of said base to form a flush surface with said top of said base.

11. A device according to claim 1 or 2 wherein said base and said sound-muting material are of a circular configuration and said one dimension is the diameter of said base.

* * * * *